US011450166B2

(12) United States Patent
Canter et al.

(10) Patent No.: US 11,450,166 B2
(45) Date of Patent: Sep. 20, 2022

(54) MULTI-PURPOSE CONFIGURABLE VOTING SYSTEM

(71) Applicant: Hart Intercivic, Inc., Austin, TX (US)

(72) Inventors: James M. Canter, Austin, TX (US); Philip J. Nathan, Royal Oak, MI (US); Edward Patrick Perez, Austin, TX (US); Denton L. Simpson, Round Rock, TX (US); Drew Eldridge Tinney, Austin, TX (US)

(73) Assignee: Hart Intercivic, Inc., Austin, TX (US)

( * ) Notice: Subject to any disclaimer, the term of this patent is extended or adjusted under 35 U.S.C. 154(b) by 1593 days.

(21) Appl. No.: 13/967,054

(22) Filed: Aug. 14, 2013

(65) Prior Publication Data

US 2014/0052505 A1 Feb. 20, 2014

Related U.S. Application Data

(60) Provisional application No. 61/683,175, filed on Aug. 14, 2012.

(51) Int. Cl.
*G07C 13/02* (2006.01)
*G07C 13/00* (2006.01)

(52) U.S. Cl.
CPC ..... *G07C 13/02* (2013.01); *G07C 13/00* (2013.01)

(58) Field of Classification Search
CPC ..... H04J 1/00; G07C 13/02; G07C 13/00
USPC ..... 705/12
See application file for complete search history.

(56) References Cited

U.S. PATENT DOCUMENTS

| | | | | |
|---|---|---|---|---|
| 5,483,276 A * | 1/1996 | Brooks | H04H 60/63 455/2.01 |
| 5,598,323 A * | 1/1997 | Muller | H01H 9/226 70/DIG. 30 |
| 6,250,548 B1 * | 6/2001 | McClure | G07C 13/00 235/51 |
| 6,609,207 B1 * | 8/2003 | Cromer | G06F 21/88 710/301 |
| 2012/0042099 A1 * | 2/2012 | Wong | G06F 21/606 710/316 |
| 2012/0190406 A1 * | 7/2012 | Chen | G06F 1/1632 361/679.41 |
| 2013/0014232 A1 * | 1/2013 | Louboutin | H04W 12/08 726/5 |

* cited by examiner

*Primary Examiner* — Zeshan Qayyum
(74) *Attorney, Agent, or Firm* — Egan, Enders & Huston LLP.

(57) ABSTRACT

A portable electronic voting machine is provided. The portable electronic voting machine comprises a smart panel configured to display voting process information; and a base station configured to house the smart panel. The electronic voting machine is configured to have the smart panel be removable from the base station and store voting information selected while the smart panel is removed from the base station.

13 Claims, 8 Drawing Sheets

STORAGE POSITION

VOTING POSITION

MULTI-PURPOSE CONFIGURABLE VOTING SYSTEM

CROSS-REFERENCE TO RELATED APPLICATION(S) AND CLAIM OF PRIORITY

The present application claims priority to U.S. Provisional Patent Application No. 61/683,175, filed Aug. 14, 2012, entitled "MULTI-PURPOSE CONFIGURABLE VOTING SYSTEMS." The content of the above-identified patent document is incorporated herein by reference.

TECHNICAL FIELD

The present application relates generally to voting machines and, more specifically, to electronic voting machines.

BACKGROUND

Voting machines are used to produce or interpret ballots; to cast and count votes; to report or display election results; and to maintain and produce any audit trail information. Electronic voting machines use modern electronic technology to improve the speed, efficiency, and accessibility of voting.

Voting machines are generally large, difficult to set up, difficult to transport, and difficult to reconfigure. Electronic voting machines are difficult to secure and there is a trade-off between ease-of-use of an electronic voting machine and the amount of security required to ensure that a voting process can be trusted to be accurate.

SUMMARY

A portable electronic voting machine is provided. The portable electronic voting machine comprises a smart panel configured to display voting process information; and a base station configured to house the smart panel. The electronic voting machine is configured to have the smart panel be removable from the base station and store voting information selected while the smart panel is removed from the base station.

A smart panel of a portable electronic voting machine is disclosed. The smart panel comprises a display to display voting process information. A base station of the electronic voting machine is configured to house the smart panel. The electronic voting machine is configured to have the smart panel be removable from the base station and store voting information selected while the smart panel is removed from the base station.

A base station of a portable electronic voting machine is provided. The base station comprises a smart panel to display voting process information. The base station is configured to house the smart panel and have the smart panel be removable from the base station. The electronic voting machine is configured to store voting information selected while the smart panel is removed from the base station.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Figure 1:
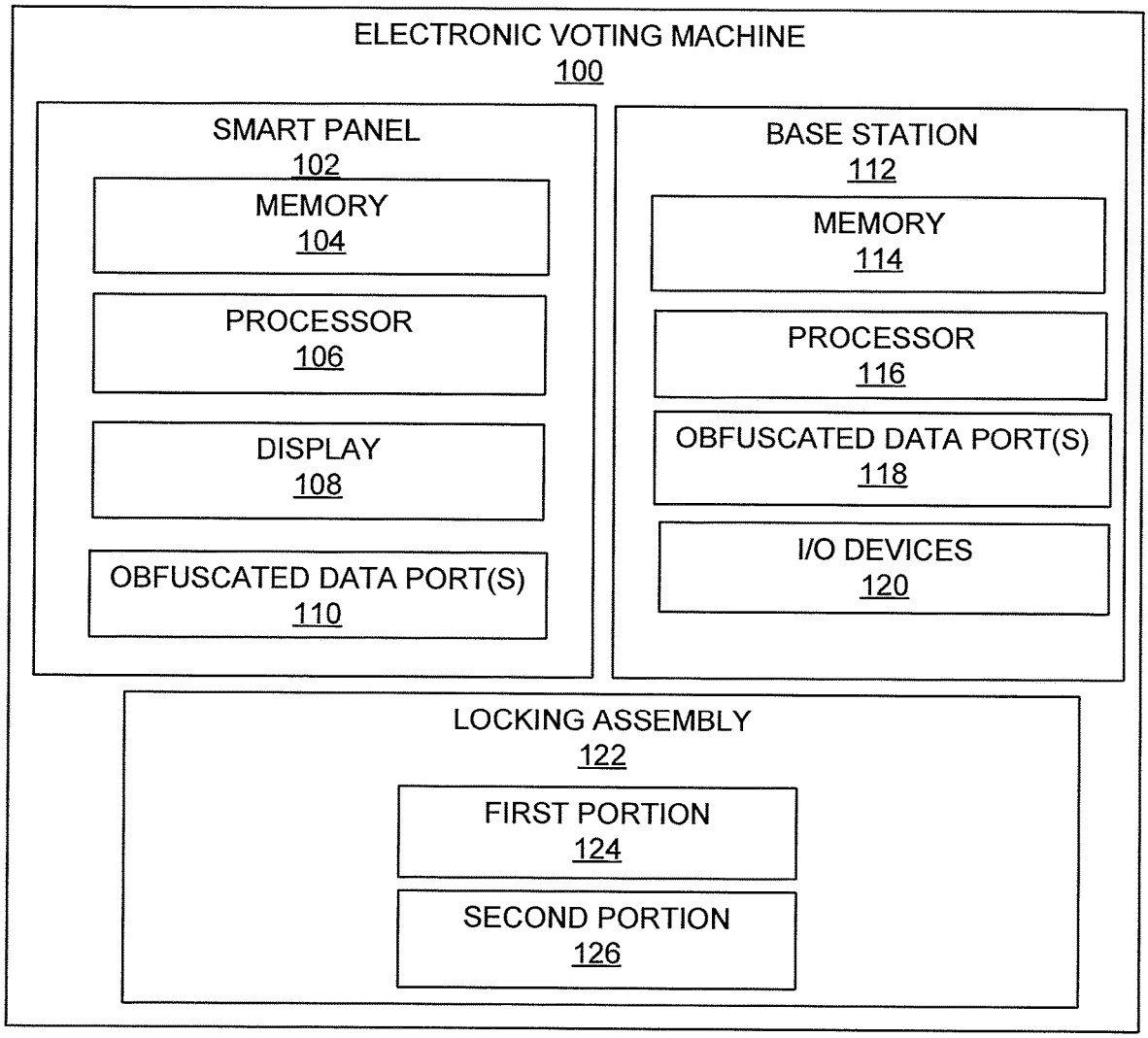
FIG. 1 is a high level block diagram for an electronic voting machine in accordance with certain embodiments of the present disclosure.

FIG. 1 is a high level block diagram for an electronic voting machine in accordance with certain embodiments of the present disclosure. The embodiment 100 shown in FIG. 1 is for illustration only. Other embodiments could be used without departing from the scope of this disclosure.

Electronic voting machine 100 comprises smart panel 102, base station 112, and locking assembly 122. Electronic voting machine 100 is a portable modular system that is used to aid the process of casting votes in an election. Electronic voting machines 100 is small, easy to set up, easy to transport, and easy to reconfigure. Electronic voting machine 100 is compliant with one or more versions of the Voluntary Voting System Guidelines (VVSG) as prepared by the United States Election Assistance Commission. Electronic voting machine 100 is configured to be reconfigurable between one or more configurations including a first configuration comprising a scan unit and a second configuration comprising an audio tactile interface (ATI) controller. Electronic voting machine 100 is configured to have smart panel 102 be removed from base station 112. Electronic voting machine 100 is configured to store voting information selected while smart panel 102 is removed from base station 112.

Smart panel 102 comprises one or more memories 104, processors 106, display 108, and obfuscated data port(s) 110. Smart panel 102 is an electronic device configured to display one or more OF voting process information and voting information. Voting process information includes one or more of the status of electronic voting machine 100 and information related to candidates and issues being voted upon in an election. For example, voting process information can include whether electronic voting machine 100 is ready to be used by a voter and can include names of candidates from which a selection may be made. Voting information includes one or more selections made by a voter regarding candidates and issues of an election. For example, voting information can include which candidate was selected by a voter.

One or more memories 104 include one or more of nonvolatile memory and instruction memory. Nonvolatile memory is used to store voting information collected via smart panel 102. Instruction memory is used to store instructions that while executed cause one or more processors 106 to operate smart panel 102.

One or more processors 106 execute instructions stored in memory 104 to operate smart panel 102. Each of the processors 106 can be a single core or multi-core processor.

Display 108 displays voting process information to a voter using electronic voting machine 100. Display 108 can be a touch screen device wherein touch inputs are used to operate electronic voting machine 100 and optionally to make voting selections. For example, a poll worker may use the touch input to operate and prepare electronic voting machine 100 for an election or to receive a ballot. A voter can use touch inputs to verify selections marked on a paper ballot and to make selections with an electronic ballot regarding candidates and issues of an election.

Obfuscated data ports 110 allow for secure connection of peripheral devices. Obfuscated data ports 110 are obfuscated via one or more of mechanical obfuscation and electrical obfuscation.

Base station 112 houses smart panel 102. Base station 112 stores voting information after smart panel 102 is reattached to base station 112. The station 112 connects electronic voting machine 100 to one or more external devices, including other electronic voting machines and printers. Base station 112 comprises one or more memories 114, one or more processors 116, one or more obfuscated data ports 118, and input/output (I/O) devices 120.

One or more memories 114 include one or more of nonvolatile memory and instruction memory. Nonvolatile memory is used to store voting information collected via smart panel 102. Instruction memory is used to store instructions that while executed cause one or more processors 106 to operate base station 112.

One or more processors 116 execute instructions stored in memory 114 to operate base station 112. Each of the processors 116 can be a single core for multiple core processors.

Obfuscated data ports 118 allow for connecting peripheral devices. Obfuscated data ports 118 are obfuscated via one or more of mechanical obfuscation and electrical obfuscation.

Input/output (I/O) devices 120 allow for operation of electronic voting machine 100. I/O devices 120 include a scan unit to scan in paper ballots and an audio tactile interface (ATI) controller for voters requiring such facilities.

Locking assembly 122 secures smart panel 102 to base station 112. When a locking state of locking assembly 122 is transition from a locked state to an unlocked state, smart panel 102 displays a password-protected screen to prevent unauthorized access to electronic voting machine 100, smart panel 102, and base station 112. Locking assembly 122 comprises a first portion 124 and a second portion 126.

First portion 124 is comprised by one or the other of base station 112 and smart panel 102. First portion 124 is configured to actuate a locking mechanism and to have the locking state of the locking assembly be detectable by one or more of the station 112 and smart panel 102.

Second portion 126 is comprised by the other of base station 112 and smart panel 102 and comprises one or more lock points. A first lock point of the one or more lock points is configured to secure smart panel 102 to base station 112 for storage and transportation of electronic voting machine 100. A second lock point of the one or more lock points secures smart panel 102 to base station 112 for receiving voting information that is received while smart panel 102 is attached to base station 112.

Those skilled in the art will recognize that the full structure and operation of an electronic voting machine in not depicted in the drawings or described herein. Instead, for simplicity and clarity, only so much of an electronic voting machine and the related devices and structures (such as peripherals) as is unique to the present disclosure or necessary for an understanding of the present disclosure is depicted and described.

FIGS. 2A through 2F illustrate certain embodiments of electronic voting machines 202-212 in accordance with the present disclosure. The embodiments shown in FIGS. 2A through 2F are for illustration only, and other embodiments could be used without departing from the scope of this disclosure. The electronic voting machines 202, 204, 206, 208, 210 and 212 each preferably include or contain the components and connections depicted in FIG. 1 for electronic voting machine 100.

Figure 2A:
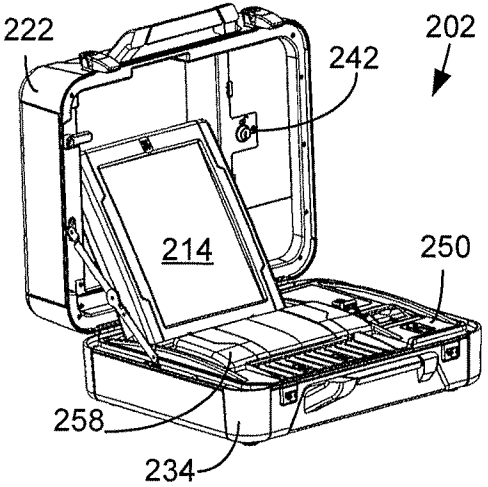
FIGS. 2A through 2F illustrate certain embodiments of electronic voting machines in accordance with the present disclosure.
Figure 2B:
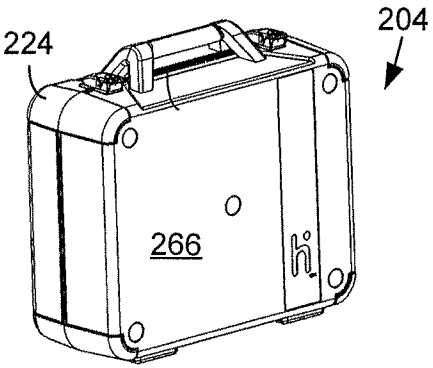
Figure 2C:
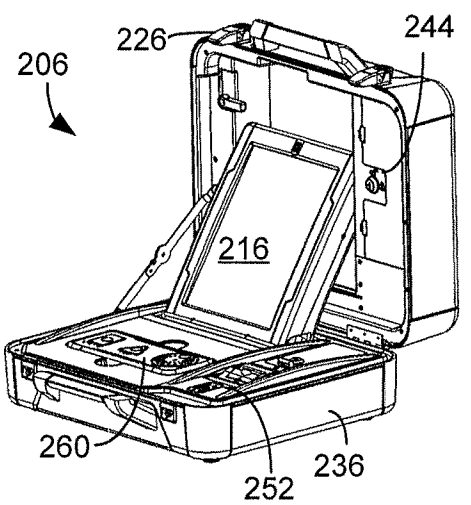
Figure 2D:
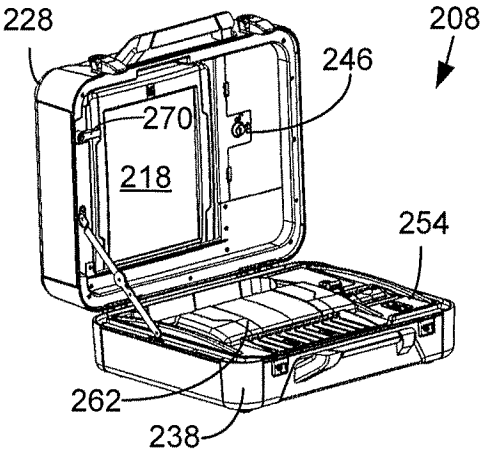
Figure 2E:
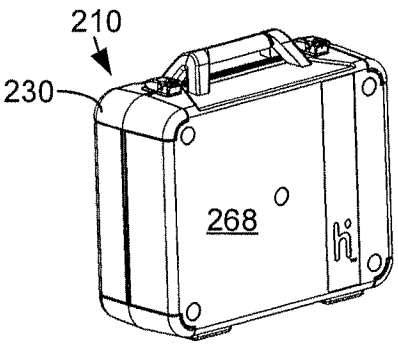
Figure 2F:
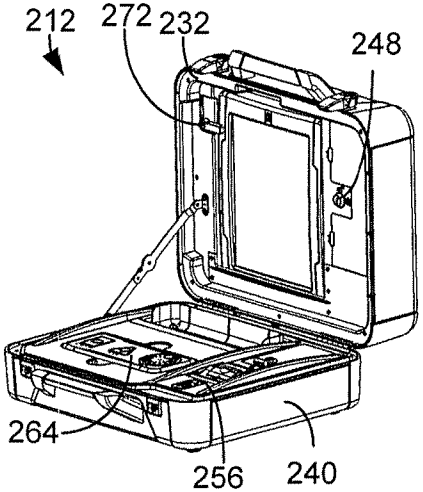

Electronic voting machines 202 and 206 in FIGS. 2A and 2C are illustrated in a configuration ready to be used by voters participating in an election with smart panels 214 and 216 attached to base station bottom portions 234 and 236 and locked via locking assemblies 242 and 244. Electronic voting machines 208 and 212 in FIGS. 2D and 2F are illustrated in an open configuration with smart panels 218 and 220 stored within cavities of the station top portions 228 and 232, locked via locking assemblies 246 and two and 48, and secured via latches 270 and 272. Electronic voting machines 204 and 210 in FIGS. 2B and 2E are illustrated in a closed configuration, ready to be transported or stored with base station bottom portions 266 and 268 latched to base station top portions 224 and 230.

Electronic voting machines 202, 206, 208, and 212 comprise printers 250, 252, 254 and 256. Printers 250, 252, 254, and 256 print results related to voting information gathered and stored by electronic voting systems 202, 206, 208, and 212.

Figure 3A:
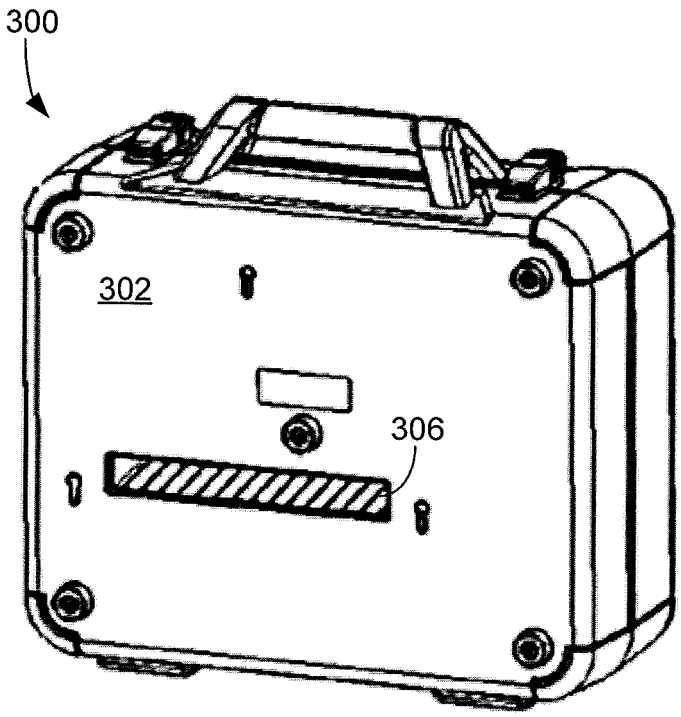
FIGS. 3A and 3B illustrate the ability to reconfigure an electronic voting machine in accordance with the present disclosure.
Figure 3B:
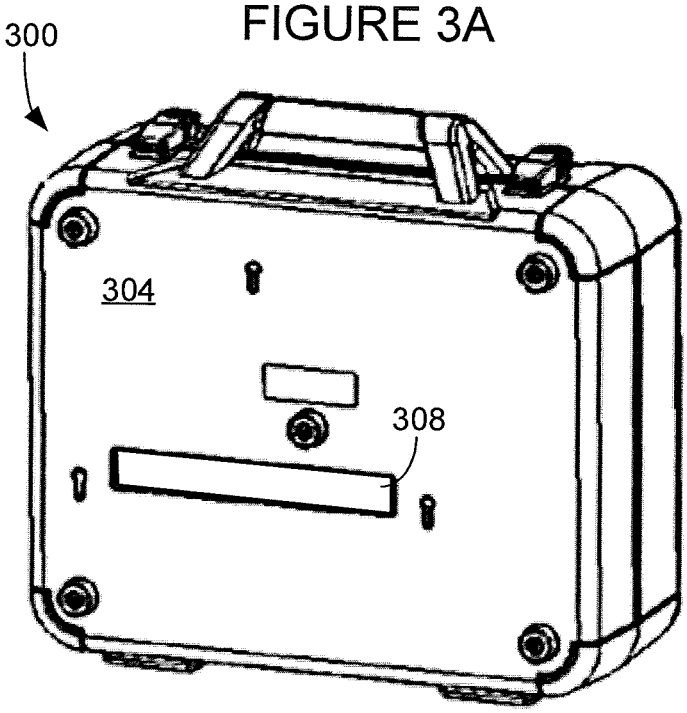

FIGS. 3A and 3B illustrate the ability to reconfigure electronic voting machine 300. The embodiments shown in FIGS. 3A and 3B are for illustration only, and other embodiments could be used without departing from the scope of this disclosure. The electronic voting machine 300 preferably includes or contains the components and connections depicted in FIG. 1 for electronic voting machine 100, and is configurable in the manner illustrated in FIGS. 2A through 2F.

First configuration 302 of electronic voting machine 300 includes a scan unit and comprises an opening 306 through which a scanned paper ballot may drop into a ballot box during use of the electronic voting machine. Electronic voting machine 300 is converted by a manufacturer or distributor of electronic voting machine 300 from first configuration 302 to second configuration 304. Second configuration 304 of electronic voting machine 300 does not include a scan unit and comprises a cover 308 installed by a manufacturer to prevent access to the inside of the electronic voting machine 300.

Figure 4A:
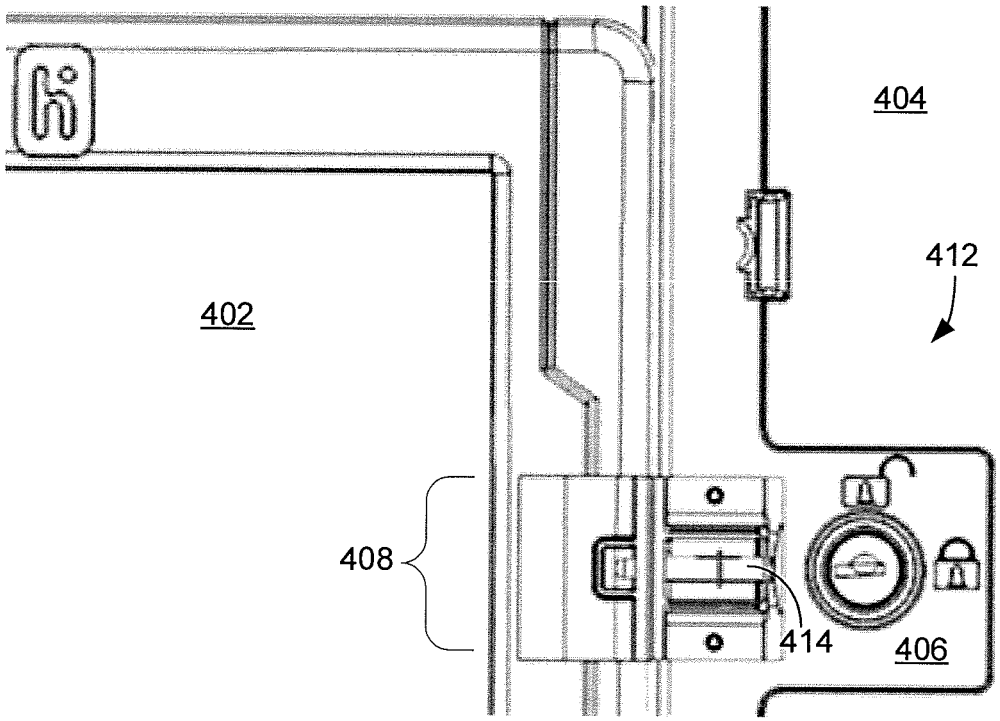
FIGS. 4A and 4B illustrate a locking assembly of an electronic voting machine in accordance with the present disclosure.
Figure 4B:
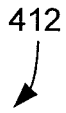
Figure 4B:
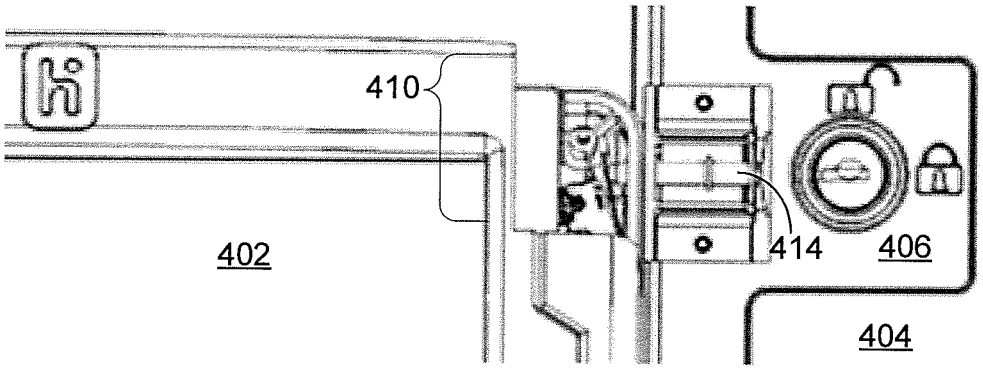

FIGS. 4A and 4B illustrate locking assembly 412 of an electronic voting machine in accordance with the present disclosure. The embodiment shown in FIG. 4 is for illustration only, and other embodiments could be used without departing from the scope of this disclosure. The locking assembly is included, for example, on the electronic voting machines illustrated in FIG. 1 and FIGS. 2A through 2F.

Locking assembly 412 comprises locking mechanism 406 of base station 404 and lock points 408 and 410 of smart panel 402. Portions of the housings of smart panel 402 and base station 404 have been removed to show inner details of locking assembly 412, locking mechanism 406, and lock points 408 and 410. Certain embodiments can have the locking mechanism comprised by the smart panel and the lock points comprised by the base station.

Locking mechanism 406 comprises plunger 414. When a locking state of locking mechanism 406 is transitioned from an unlocked state to a locked state, plunger 414 extends into one of lock points 408 and 410 of smart panel 402. The locking state of locking mechanism 406 is detected by one or more of base station 404 and smart panel 402. When base station 404 detects the locking state has transitioned away from the locked state or to the unlocked state, base station 404 sends an electronic signal to smart panel 402 that, when received by smart panel 402, causes smart panel 402 to display a password protect screen and prevent voting activity. The password protect screen requires that a password must be entered before the electronic voting machine comprising smart panel 402 can be further used in a voting process. This safety feature prevents tampering with smart panel 402 in an event that locking assembly 412 or locking mechanism 406 is inadvertently transitioned away from the locked state or transitioned to the unlocked state.

Figure 5:
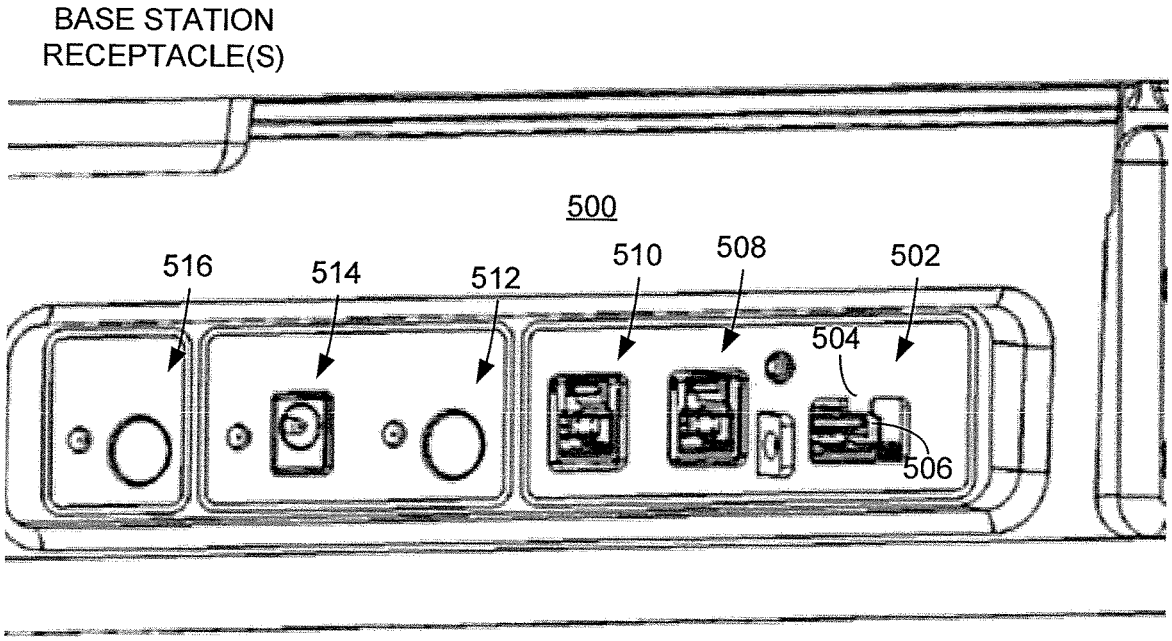
FIG. 5 illustrates a mechanically obfuscated receptacle of a base station of an electronic voting machine in accordance with the present disclosure.

FIG. 5 illustrates mechanically obfuscated receptacle 502 of base station 500 of an electronic voting machine. The embodiment shown in FIG. 5 is for illustration only, and other embodiments could be used without departing from the scope of this disclosure. The mechanically obfuscated receptacle is included, for example, on the electronic voting machines illustrated in FIG. 1 and FIGS. 2A through 2F.

Base station 500 comprises mechanically obfuscated receptacle 502, receptacle 508 and 510, power button 512, power receptacle 514, and poll worker button 516. Receptacles 508 and 510 are used to connect the electronic voting machine comprising base station 500 to other electronic voting machines. Power button 512 is used to turn the electronic voting machine comprising base station 500 on and off.

Mechanically obfuscated receptacle 502 in the example shown comprises recessed socket 506 and mechanical key 504. Recessed socket 506 is a standard receptacle, such as a universal serial bus USB type A receptacle. Recessed socket 506 is recessed a non-standard distance inside a housing of base station 500 that, in coordination with mechanical key 504, operates to prevent a standard USB type A plug from being able to be sufficiently inserted into mechanically obfuscated receptacle 502 to make the appropriate electrical connections. Only a connector with elongate connection region can be inserted a sufficient distance to make the electrical connections necessary for communication via the mechanically obfuscated receptacle 502.

Mechanical key 504 comprises a certain shape that prevents standard plugs that do not account for that certain shape from being able to be inserted into recessed socket 506. In the example shown, ridges will obstruct insertion of a standard USB type A connector housing. Mechanically obfuscated receptacle 502 is keyed via mechanical key 504 to allow only certain plugs that take into account mechanical key 504—i.e., those with one or more grooves corresponding to the key ridges in position and width.

Poll worker button 516 provides for poll worker access to the electronic voting machine. When pressed, home button 516 causes the station 500 to send an electrical signal to a smart panel of the electronic voting machine comprising base station 500 that causes the smart panel to display a password protect screen and prevent voting activity. After entering a password at the password protect screen, a poll worker access is granted and may be used to perform diagnostics, run reports, update voting information, and the like.

Figure 6:
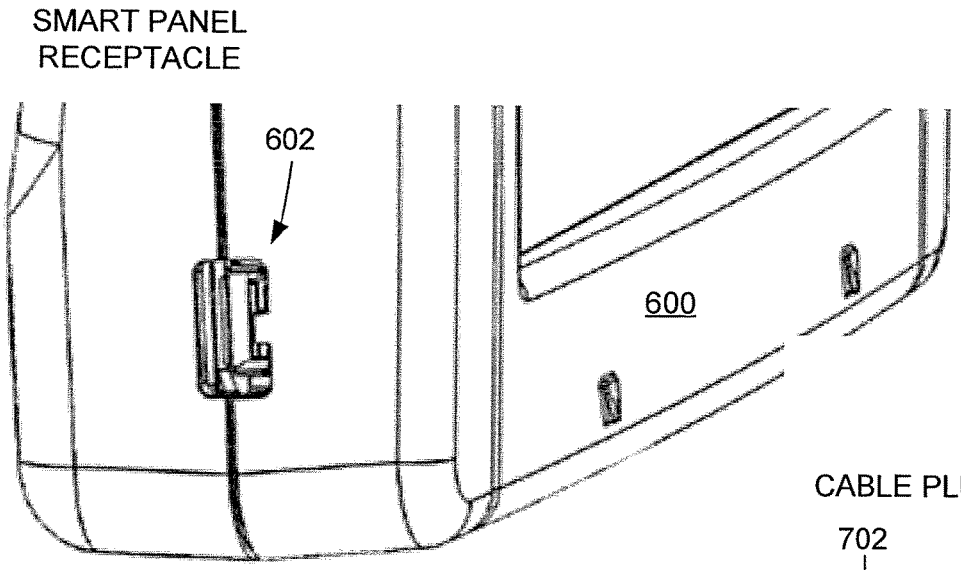
FIG. 6 illustrates a mechanically obfuscated receptacle of a smart panel of an electronic voting machine in accordance with the present disclosure.

FIG. 6 illustrates mechanically obfuscated receptacle 602 of smart panel 600 of an electronic voting machine. The embodiment shown in FIG. 6 is for illustration only. Other embodiments could be used without departing from the scope of this disclosure. The mechanically obfuscated receptacle is included, for example, on the electronic voting machines illustrated in FIG. 1 and FIGS. 2A through 2F.

Smart panel 600 comprises a mechanically obfuscated receptacle 602 similar to the mechanically obfuscated receptacle 502 of base station 500 of FIG. 5. Mechanically obfuscated receptacle 602 is located at a portion of smart panel 600 that is accessible while smart panel 600 is attached to a base station of the electronic voting machine comprising smart panel 600. Mechanically obfuscated receptacle 602 is used to connect smart panel 602 and ATI control to collect voting information while smart panel 600 is detached from the base station. Preferably distinct keying is employed for the two mechanically obfuscated receptacles.

Figure 7:
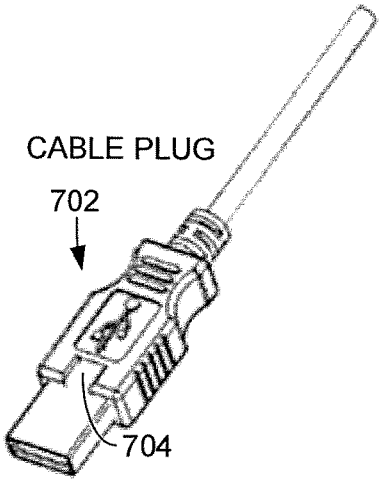
FIG. 7 illustrates a keyed plug to be used with a mechanically obfuscated receptacle of an electronic voting machine in accordance with the present disclosure.

FIG. 7 illustrates keyed plug 702 to be used with a mechanically obfuscated receptacle of an electronic voting machine. The embodiment shown in FIG. 7 is for illustration only. Other embodiments could be used without departing from the scope of this disclosure. The keyed plug is employed, for example, within the electronic voting machines illustrated in FIG. 1 and FIGS. 2A through 2F, and in connection with the mechanically obfuscated receptacle of one of FIGS. 5 and 6.

Keyed plug 702 comprises key 704 that allows keyed plug 702 to be used with a mechanically obfuscated receptacle of an electronic voting machine. Keyed plug 702 is one end of a non-standard cable that is used to connect an electronic voting machine to another device.

Figure 8:
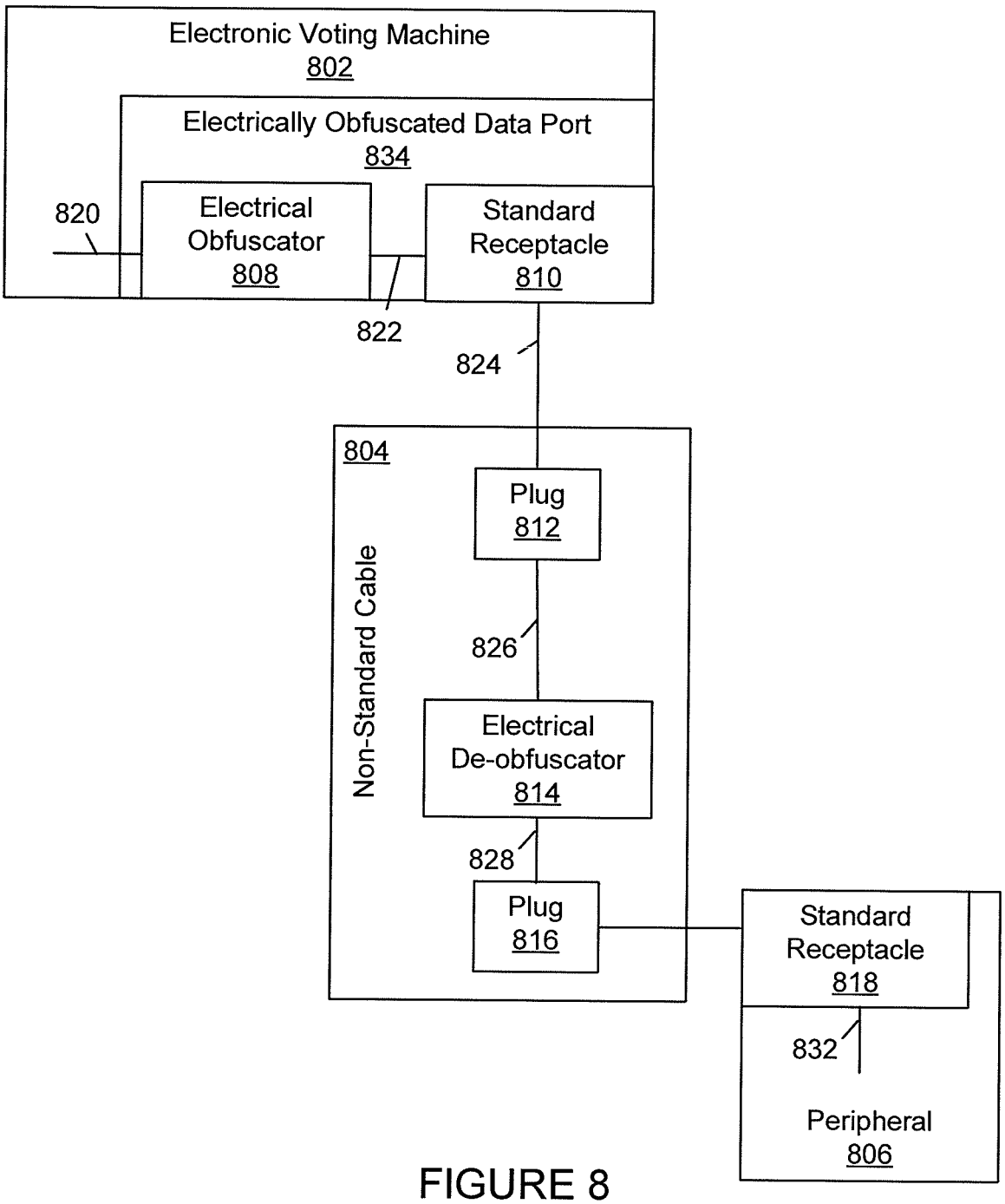
FIG. 8 is a high level block diagram for an electrically obfuscated data port of an electronic voting machine.

FIG. 8 is a high level block diagram of an electrically obfuscated data port 834 of electronic voting machine 802. The embodiment shown in FIG. 8 is for illustration only. Other embodiments could be used without departing from the scope of this disclosure. The electrically obfuscated data port is included, for example, in the electronic voting machines illustrated in FIG. 1 and FIGS. 2A through 2F.

Electronic voting machine 802 is connected to peripheral 806 via non-standard cable 804. Electronic voting machine 802 is prevented from being connected directly to standard compliant devices and peripherals without non-standard cable 804. Electronic voting machine 802 comprises electrically obfuscated data port 834.

Electrically obfuscated data port 834 prevents the standard devices and peripherals from being connected to electronic voting machines 802 by use of standard electrical signals over non-standard electrical wirings. For example, electrically obfuscated data port 834 can comprise a USB type A receptacle wherein standard USB electrical signals do not accord with the standard electrical wiring of the USB type A receptacle. Electrically obfuscated data port 834 comprises electrical obfuscator 808 and standard receptacle 810.

By way of example, electrical obfuscator 808 switches or swaps two or more standard compliant electrical signals 820 to form non-standard electrical signals 822 that are sent through standard receptacle connectors 810. Standard compliant electrical signals 820 include one or more power signals and data signals, any one of which can be swapped or switched with another fixedly or for a predetermined period of time. Electrical obfuscator 808 can use standard compliant electrical signals 820 and derivations thereof to determine which electrical signals to switch and for how long to switch those electrical signals. For example, electrical obfuscated 808 can comprise a counter used to switch a ground signal with one of a first data signal and a second data signal every 1000 clock cycles, wherein the clock cycles are derived from standard electrical signals 820. The cycle of which signals to switch and for how long are predetermined and can be fixed or pseudorandom. Certain embodiments may have a pseudorandom cycle that is keyed to or based on a serial number or model number of electronic voting machine 802, a base station comprised by electronic voting machine 802, or a smart panel comprised by electronic voting machines 802.

Standard receptacle 810 conforms mechanically to a standard, such as USB, but does not conform electrically. Standard receptacle 810 outputs non-standard compliant electrical signals 822 as non-standard compliant electrical signals 824, which are passed through nonstandard cable 804 as non-standard signals 826.

Non-standard cable 804 allows electronic voting machine 802 to be connected to peripheral 806 via electrically obfuscated data port 834 of electronic voting machine 802. Nonstandard cable 804 comprises plug 812, plug 816, and electrical de-obfuscator 814. Except for electrical characteristics, the obfuscated, nonstandard cable 804, plug 812, and plug 816 are otherwise standard compliant.

Electrical deobfuscator 814 receives non-standard electrical signals 826 and outputs standard electrical signals 828 to be received by peripheral 806 via plug 816 of nonstandard cable 804 and standard receptacle 818 of peripheral 806. Electrical deobfuscator 814 switches or swaps two or more non-standard electrical signals 826 to form standard electrical signals 828. Non-standard electrical signals 826 include one or more power signals and data signals any one or more of which were switched or swapped with other signals for a predetermined period of time. Electrical deobfuscator 814 can use non-standard electrical signals 826 and derivations thereof to determine which electrical signals to switch and for how long to switch those electrical signals. For example, electrical deobfuscator 814 can comprise a counter used to switch a ground signal with one of a first data signal and a second data signal every 1000 clock cycles, wherein the clock cycles are derived from standard electrical signals 820. The cycle of which signals to switch and for how long are predetermined and can be fixed or pseudorandom. Certain embodiments may have a pseudorandom cycle that is keyed to or based on a serial number or model number of non-standard cable 804.

Peripheral 806 receives standard electrical signals 830 via standard receptacle 818. Standard receptacle 818 receives standard electrical signals 830 and passes through standard electrical signals 830 as standard signals 832 using standard wirings so that peripheral 806 can communicate with electronic voting machines 802. Peripheral 806 can be any standard compliant device, such as a USB printer.

Figure 9:
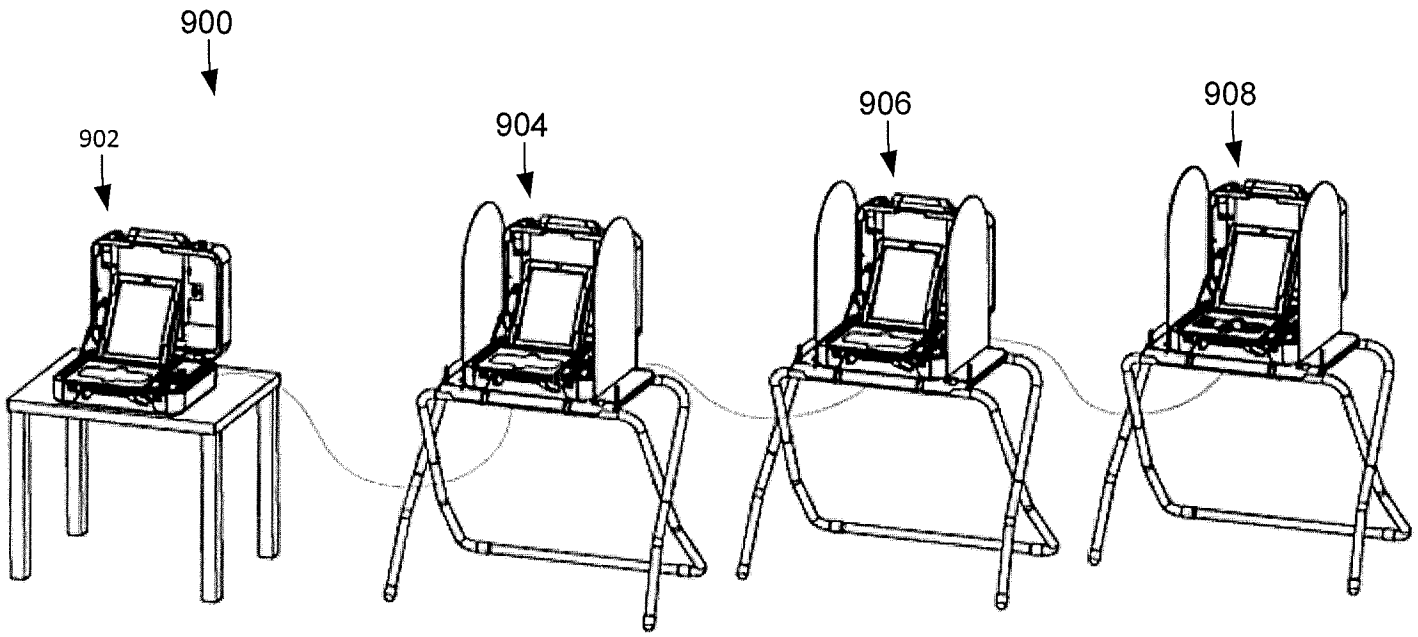
FIG. 9 illustrates an electronic voting system set up to store electronic votes in accordance with the present disclosure.

FIG. 9 illustrates an electronic voting system set up to store electronic votes. The embodiment shown in FIG. 9 is for illustration only. Other embodiments could be used without departing from the scope of this disclosure. The electronic voting system includes, for example, a plurality of the electronic voting machines illustrated in FIG. 1 and FIGS. 2A through 2F.

Electronic voting system 900 preferably comprises multiple interconnected electronic voting machines 902-908 that are daisy chained together. Electronic voting machine 902 is set up as a poll worker terminal to monitor and or control electronic voting machines 904-908 and optionally updates voting process information on electronic voting machines 904-908. Electronic voting machines 904-908 are direct store electronic (DRE) voting machines that store votes electronically and pass voting information back to electronic voting machine 902. Connections between electronic voting machines 902-08 are via data ports that are one or more of mechanically obfuscated and electrically obfuscated. Electronic voting machine 908 comprises an ATI controller.

Figure 10:
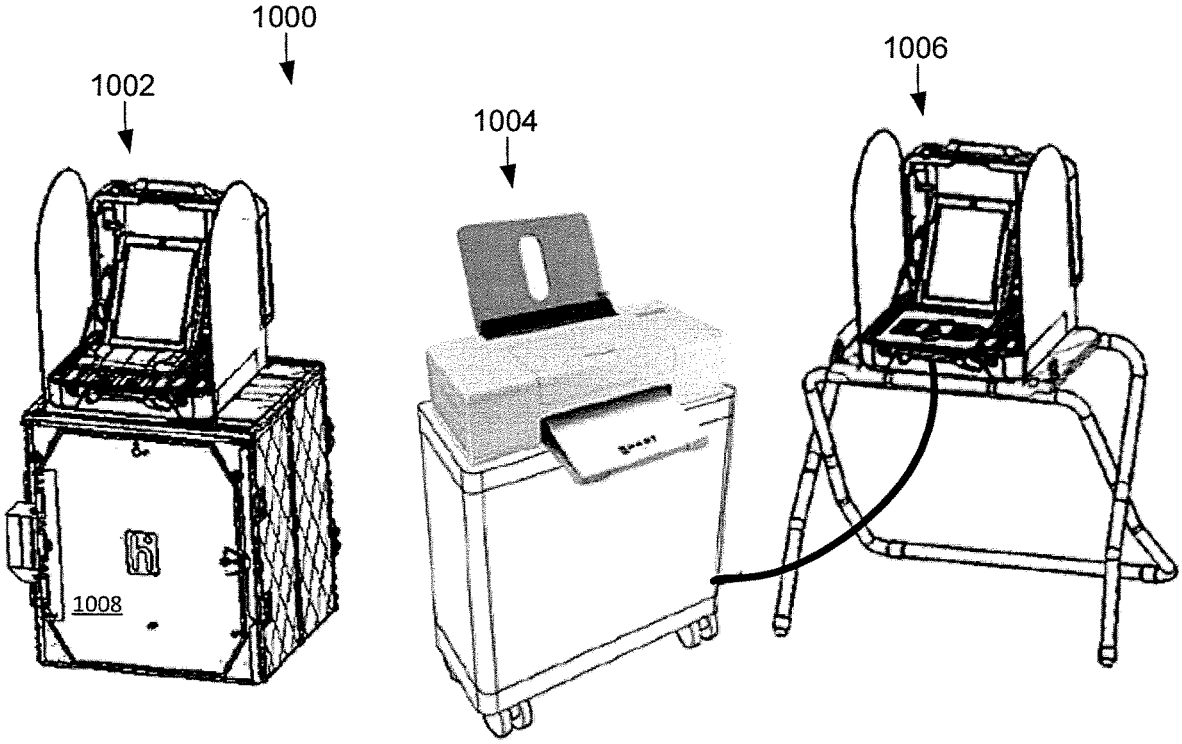
FIG. 10 illustrates an alternative electronic voting system set up to store paper ballot votes in accordance with the present disclosure.

FIG. 10 illustrates an alternative electronic voting system set up to store paper ballot votes. The embodiment shown in FIG. 10 is for illustration only. Other embodiments could be used without departing from the scope of this disclosure. The electronic voting system includes, for example, a plurality of the electronic voting machines illustrated in FIG. 1 and FIGS. 2A through 2F.

Electronic voting system 1000 comprises multiple electronic voting machines 1002 and 1006 and standard printer 1004. Electronic voting machines 1006 and standard printer 1004 are connected via a nonstandard cable between a data port of electronic voting machine 1006 and a data port of printer 1004. The data port of electronic voting machine 1006 is one or more of mechanically obfuscated and electrically obfuscated. The data port of printer 1004 is a standard data port. Voter selections are made via electronic voting machine 1006 and printed onto paper ballots via printer 1004. The paper ballot is scanned via electronic voting machine 1002 and deposited into ballot box 1008 via electronic voting machine 1002. Electronic voting machines 1002 allow a voter to verify a paper ballot before it is deposited into ballot box 1008.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A voting system comprising:

a portable electronic voting machine, the portable electronic voting machine configured to be compliant with at least one or more governmental voting guidelines, the portable electronic voting machine comprising, a smart panel, the smart panel configured to process and display voting process information and voting information, wherein the voting information comprises voting selections of a voter, the smart panel configured to allow the voter to interact with the smart panel through at least a display in order to input voter selections into the smart panel; and a base station configured to house the smart panel on the base station and to physically support the smart panel so that the base station and the smart panel may be physically attached to each other with the base station physically supporting the smart panel during physical attachment, and the base station also configured to receive signals from the smart panel when the base station and the smart panel are physically attached, the signals from the smart panel including at least signals indicative of the voting selections of the voter, the base station configured to store the signals indicative of the voting selections of the voter, wherein the base station and the smart panel are configured to selectively allow removal of the smart panel from the base station so the base station no longer physically supports the smart panel when the smart panel is selectively removed.

2. The voting system of claim 1, wherein the portable electronic voting machine is configured to be reconfigurable between one or more configurations including a first configuration comprising a scan unit and a second configuration comprising an audio tactile interface (ATI) controller.

3. The voting system of claim 1, further comprising:

a locking assembly configured to secure the smart panel to the base station, wherein, when a locking state of the locking assembly is transitioned from a locked state to an unlocked state, the smart panel is configured to display a password-protect screen.

4. The voting system of claim 3, wherein the locking assembly comprises:

a first portion formed by part of one of the base station and the smart panel, the first portion configured to actuate a locking mechanism and to have the locking state be detectable by the one of the base station and the smart panel; and a second portion formed by part of the other of the base station and the smart panel, the second portion comprising one or more lock points, wherein a first lock point of the one or more lock points is configured to secure the smart panel to the base station for storage and transportation of the portable electronic voting machine, and wherein a second lock point of the one or more lock points configured to secure the smart panel to the base station for receiving voting information that is received while the smart panel is attached to the base station.

5. The voting system of claim 1, further comprising:

a plurality of obfuscated data ports each configured to provide a secure data connection between the portable electronic voting machine and at least one of one or more external devices, wherein the base station is configured to connect the portable electronic voting machine to the one or more external devices.

6. The voting system of claim 5, wherein each obfuscated data port is configured to be mechanically obfuscated and electrically obfuscated, wherein the mechanical obfuscation is configured to use a standard data receptacle, and to prevent mechanical connections between the standard data receptacle and a standard data plug by the standard data receptacle being recessed by a non-standard amount within a housing of the electronic voting machine, and an opening of the housing being keyed, and wherein the electrical obfuscation is configured to use standard electrical signals over non-standard electrical wirings by switching two or more connection points for the standard electrical signals.

7. The voting system of claim 1, the wherein the portable electronic voting machine is configured to allow the voting selections of the voter to be selected while the smart panel is removed from the base station.

8. The voting system of claim 7, the smart panel comprising memory, the smart panel configured to store in the memory the voting selections of the voter that are selected while the smart panel is removed from the base station.

9. The voting system of claim 7, wherein the portable electronic voting machine is configured to allow the voting selections of the voter, selected while the smart panel is removed from the base station, to be stored by the base station after the smart panel is reattached to the base station.

10. The voting system of claim 9, wherein the portable electronic voting machine is configured to be reconfigurable between one or more configurations including a first configuration comprising a scan unit and a second configuration comprising an audio tactile interface (ATI) controller.

11. The voting system of claim 9, further comprising:

a locking assembly configured to secure the smart panel to the base station, wherein, when a locking state of the locking assembly is transitioned from a locked state to an unlocked state, the smart panel is configured to display a password-protect screen.

12. The voting system of claim 9, further comprising:

a plurality of obfuscated data ports each configured to provide a secure data connection between the portable electronic voting machine and at least one of one or more external devices, wherein the base station is configured to connect the portable electronic voting machine to the one or more external devices.

13. The voting system of claim 12, wherein each obfuscated data port is configured to be mechanically obfuscated and electrically obfuscated, wherein the mechanical obfuscation is configured to use a standard data receptacle, and to prevent mechanical connections between the standard data receptacle and a standard data plug by the standard data receptacle being recessed by a non-standard amount within a housing of the electronic voting machine, and an opening of the housing being keyed, and wherein the electrical obfuscation is configured to use standard electrical signals over non-standard electrical wirings by switching two or more connection points for the standard electrical signals.

* * * * *